US011794495B2

(12) United States Patent
Kato et al.

(10) Patent No.: US 11,794,495 B2
(45) Date of Patent: Oct. 24, 2023

(54) INKJET PRINTING APPARATUS AND PRINTING METHOD WITH CONVEYING PRINT MEDIUM IN FIRST DIRECTION AND SECOND DIRECTION AND WITH CONTROL OF NIP OF CONVEYANCE ROLLERS

(71) Applicant: CANON KABUSHIKI KAISHA, Tokyo (JP)

(72) Inventors: Masataka Kato, Kanagawa (JP); Kazuhiko Sato, Tokyo (JP); Kazuo Suzuki, Kanagawa (JP); Yoshinori Nakajima, Kanagawa (JP); Mitsutoshi Nagamura, Tokyo (JP); Shin Genta, Kanagawa (JP); Satoshi Azuma, Tokyo (JP); Shingo Nishioka, Kanagawa (JP); Sae Mogi, Kanagawa (JP); Taku Yokozawa, Kanagawa (JP); Noboru Kunimine, Tokyo (JP); Akiko Aichi, Tokyo (JP); Hiroshi Taira, Tokyo (JP); Hiroto Kango, Tokyo (JP); Hiroshi Kawafuji, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 17/536,186

(22) Filed: Nov. 29, 2021

(65) Prior Publication Data

US 2022/0080747 A1 Mar. 17, 2022

Related U.S. Application Data

(63) Continuation of application No. PCT/JP2020/020223, filed on May 22, 2020.

(30) Foreign Application Priority Data

Jun. 4, 2019 (JP) ..... 2019-104719
Jun. 25, 2019 (JP) ..... 2019-117137

(51) Int. Cl.
*B41J 11/00* (2006.01)
*B41J 13/00* (2006.01)
(Continued)

(52) U.S. Cl.
CPC ..... *B41J 11/008* (2013.01); *B41J 11/009* (2013.01); *B41J 11/0035* (2013.01); *B41J 11/42* (2013.01); *B41J 13/0045* (2013.01); *B41J 29/393* (2013.01)

(58) Field of Classification Search
CPC ..... B41J 11/008; B41J 11/0035; B41J 11/009; B41J 11/42; B41J 13/0045; B41J 29/393
See application file for complete search history.

(56) References Cited

U.S. PATENT DOCUMENTS 5,311,214 A 5/1994 Hirasawa et al.
5,739,828 A 4/1998 Moriyama et al.
(Continued)

FOREIGN PATENT DOCUMENTS

JP 2004-209679 A 7/2004
JP 2006-096022 A 4/2006
(Continued)

OTHER PUBLICATIONS

Aug. 4, 2020 International Search Report in International Patent Appln. No. PCT/JP2020/020223.
(Continued)

*Primary Examiner* — Henok D Legesse
(74) *Attorney, Agent, or Firm* — Venable LLP

(57) ABSTRACT

An object is to provide a full-line inkjet printing apparatus and a printing method that can suppress occurrence of image degradation in the case where a conveyance roller conveys a print medium and multipass printing is performed. The
(Continued)

maximum conveyance amount in a return route is set to be smaller than a distance between the conveyance roller and a print head.

14 Claims, 11 Drawing Sheets

(51) Int. Cl.
*B41J 29/393* (2006.01)
*B41J 11/42* (2006.01)

(56) References Cited

U.S. PATENT DOCUMENTS 5,887,991 A 3/1999 Narita et al.
5,895,155 A 4/1999 Narita et al.
6,089,697 A 7/2000 Tajika et al.
6,099,116 A 8/2000 Fujita et al.
6,120,141 A 9/2000 Tajika et al.
6,158,834 A 12/2000 Kato et al.
6,196,655 B1 3/2001 Hirasawa et al.
6,206,502 B1 3/2001 Kato et al.
6,234,606 B1 5/2001 Suzuki
6,264,320 B1 5/2001 Suzuki
6,309,051 B1 10/2001 Koitabashi et al.
6,325,492 B1 12/2001 Koitabashi et al.
6,390,583 B1 5/2002 Kato et al.
6,412,934 B1 7/2002 Moriyama et al.
6,435,639 B1 8/2002 Nakajima et al.
6,450,606 B1 9/2002 Kato et al.
6,467,866 B1 10/2002 Nagoshi et al.
6,474,768 B1 11/2002 Yano et al.
6,494,557 B1 12/2002 Kato et al.
6,505,909 B1 1/2003 Kato et al.
6,572,216 B1 6/2003 Koitabashi et al.
6,585,353 B1 7/2003 Kanematsu et al.
6,612,678 B2 9/2003 Kato et al.
6,650,350 B2 11/2003 Suzuki et al.
6,652,053 B2 11/2003 Imanaka et al.
6,834,947 B2 12/2004 Moriyama et al.
6,859,220 B2 2/2005 Suzuki et al.
6,860,578 B2 3/2005 Yamada et al.
6,877,835 B2 4/2005 Kato et al.
6,918,656 B2 7/2005 Koitabashi et al.
6,966,629 B2 11/2005 Nakajima et al.
6,986,824 B2 1/2006 Suzuki et al.
6,988,783 B2 1/2006 Ikeda et al.
6,991,327 B2 1/2006 Goto et al.
6,992,690 B2 1/2006 Mogi et al.
7,044,592 B2 5/2006 Sato et al.
7,097,267 B2 8/2006 Kato et al.
7,119,914 B2 10/2006 Nakajima et al.
7,125,095 B2 10/2006 Yamada et al.
7,144,093 B2 12/2006 Nakajima et al.
7,281,780 B2 10/2007 Nagamura et al.
7,347,519 B2 3/2008 Nagamura et al.
7,367,643 B2 5/2008 Furuichi et al.
7,396,098 B2 7/2008 Kanematsu et al.
7,413,361 B2 8/2008 Kawaguchi
7,425,056 B1 9/2008 Koitabashi et al.
7,445,313 B2 11/2008 Tsutsumi et al.
7,460,271 B2 12/2008 Kanematsu et al.
7,517,044 B2 4/2009 Suzuki et al.
7,556,343 B2 7/2009 Kato et al.
7,758,154 B2 7/2010 Yokozawa
7,762,640 B2 7/2010 Kanda et al.
7,775,622 B2 8/2010 Suzuki et al.
7,789,476 B2 9/2010 Fomida et al.
7,891,754 B2 2/2011 Nagamura et al.
7,980,652 B2 7/2011 Baba et al.
8,057,009 B2 11/2011 Tomida et al.
8,240,802 B2 8/2012 Nakano et al.
8,366,230 B2 2/2013 Taira et al.
8,371,673 B2 2/2013 Maru et al.
8,388,090 B2 3/2013 Nakajima et al.
8,444,246 B2 5/2013 Muro et al.
8,469,484 B2 6/2013 Jogo et al.
8,517,490 B2 8/2013 Kanematsu et al.
8,608,277 B2 12/2013 Tomida et al.
8,613,492 B2 12/2013 Suzuki et al.
8,622,501 B2 1/2014 Komamiya et al.
8,628,163 B2 1/2014 Kanematsu et al.
8,630,017 B2 1/2014 Kanematsu et al.
8,636,334 B2 1/2014 Nishioka et al.
8,651,616 B2 2/2014 Maru et al.
8,675,250 B2 3/2014 Muro et al.
8,702,192 B2 4/2014 Danzuka et al.
8,721,021 B2 5/2014 Nakajima et al.
8,727,477 B2 5/2014 Kosaka et al.
8,757,754 B2 6/2014 Azuma et al.
8,783,832 B2 7/2014 Oonuki et al.
8,814,310 B2 8/2014 Hayashi
8,845,060 B2 9/2014 Azuma et al.
8,888,223 B2 11/2014 Oonuki et al.
8,931,869 B2 1/2015 Kawafuji
8,950,843 B2 2/2015 Oikawa et al.
8,960,841 B2 2/2015 Utsunomiya et al.
9,028,029 B2 5/2015 Azuma et al.
9,028,049 B2 5/2015 Azuma et al.
9,033,471 B2 5/2015 Oonuki et al.
9,039,112 B2 5/2015 Murayama et al.
9,039,120 B2 5/2015 Nishioka
9,039,157 B2 5/2015 Ogata et al.
9,079,421 B2 7/2015 Kato et al.
9,108,409 B2 8/2015 Suzuki et al.
9,114,607 B2 8/2015 Ishii et al.
9,126,403 B2 9/2015 Ojiro et al.
9,211,748 B2 12/2015 Baba et al.
9,340,009 B2 5/2016 Murayama et al.
9,434,196 B2 9/2016 Fukasawa et al.
9,545,791 B2 1/2017 Oonuki et al.
10,668,717 B2 6/2020 Azuma et al.
11,077,687 B2 8/2021 Nishioka et al.
2006/0044331 A1 3/2006 Tsutsumi et al.
2006/0098073 A1 5/2006 Kawaguchi
2009/0021548 A1 1/2009 Suzuki et al.
2009/0079777 A1 3/2009 Nagamura et al.
2011/0032296 A1 2/2011 Nakano et al.
2012/0033006 A1 2/2012 Murayama et al.
2012/0050360 A1 3/2012 Nagamura
2012/0069067 A1 3/2012 Torigoe et al.
2012/0194589 A1 8/2012 Hayashi
2013/0235107 A1 9/2013 Ibe et al.
2014/0015883 A1* 1/2014 Utsunomiya ..... B41J 13/0045 347/12
2017/0297344 A1 10/2017 Ibe et al.
2017/0341367 A1 11/2017 Holtman et al.
2020/0290367 A1 9/2020 Kawafuji
2021/0060982 A1 3/2021 Genta et al.
2021/0300031 A1 9/2021 Kawafuji et al.
2021/0402813 A1 12/2021 Murase et al.
2022/0001666 A1 1/2022 Kuriyama et al.

FOREIGN PATENT DOCUMENTS

JP 2006-130789 A 5/2006
JP 2007-268862 A 10/2007
JP 2012-157999 A 8/2012
JP 2014-015011 A 1/2014

OTHER PUBLICATIONS

Apr. 4, 2023 Japanese Official Action in Japanese Patent Appln. No. 2019-104719.
Aug. 22, 2023 Japanese Official Action in Japanese Patent Appln. No. 2019-104719.

* cited by examiner

| TYPE OF PRINT MEDIUM | ORDINARY PAPER | COATED PAPER | GLOSSY PAPER | SEMI-GLOSSY PAPER | ART PAPER | FILM |
|---|---|---|---|---|---|---|
| CONVEYANCE DISTANCE | L1 | L1 | L2 | L2 | L2 | L2 |
| PRINT MODE | MODE A | MODE A | MODE B | MODE B | MODE B | MODE B |

FIG.7

FIG.8A

| TYPE OF PRINT MEDIUM | ORDINARY PAPER | COATED PAPER | GLOSSY PAPER | SEMI-GLOSSY PAPER | FILM |
|---|---|---|---|---|---|
| SURFACE ROUGHNESS (μm) | 25 | 14 | 4 | 5 | 3 |
| CONVEYANCE DISTANCE | L3 | L1 | L2 | L2 | L2 |
| PRINT MODE | MODE A' | MODE A | MODE B | MODE B | MODE B |

FIG.8B

| TYPE OF PRINT MEDIUM | COATED PAPER A | COATED PAPER B | COATED PAPER C |
|---|---|---|---|
| THICKNESS OF PRINT MEDIUM (μm) | 90 | 180 | 300 |
| CONVEYANCE DISTANCE | L3 | L1 | L2 |
| PRINT MODE | MODE A' | MODE A | MODE B |

FIG.8C

| TYPE OF PRINT MEDIUM | COATED PAPER D | COATED PAPER E | COATED PAPER F |
|---|---|---|---|
| TRANSFER AMOUNT ($ml/m^2$) | 40 | 30 | 18 |
| CONVEYANCE DISTANCE | L3 | L1 | L2 |
| PRINT MODE | MODE A' | MODE A | MODE B |

| TYPE OF PRINT MEDIUM | COATED PAPER | COATED PAPER | COATED PAPER |
|---|---|---|---|
| INK APPLICATION AMOUNT (%) | LESS THAN 30 | 30-90 | MORE THAN 90 |
| CONVEYANCE DISTANCE | L3 | L1 | L2 |
| PRINT MODE | MODE A' | MODE A | MODE B |

FIG.9

FIG.11A

| TYPE OF PRINT MEDIUM | COATED PAPER | COATED PAPER |
|---|---|---|
| TYPE OF INK | DYE | PIGMENT |
| CONVEYANCE DISTANCE | L1 | L2 |
| PRINT MODE | MODE A | MODE B |

FIG.11B

| TYPE OF PRINT MEDIUM | COATED PAPER | COATED PAPER | COATED PAPER |
|---|---|---|---|
| TEMPERATURE (°C) | LOWER THAN 15 | 15-28 | HIGHER THAN 28 |
| CONVEYANCE DISTANCE | L3 | L1 | L2 |
| PRINT MODE | MODE A' | MODE A | MODE B |

FIG.11C

| TYPE OF PRINT MEDIUM | COATED PAPER | COATED PAPER | COATED PAPER |
|---|---|---|---|
| HUMIDITY (°C) | LOWER THAN 30 | 30-60 | HIGHER THAN 60 |
| CONVEYANCE DISTANCE | L3 | L1 | L2 |
| PRINT MODE | MODE A' | MODE A | MODE B |

INKJET PRINTING APPARATUS AND PRINTING METHOD WITH CONVEYING PRINT MEDIUM IN FIRST DIRECTION AND SECOND DIRECTION AND WITH CONTROL OF NIP OF CONVEYANCE ROLLERS

CROSS-REFERENCE TO RELATED APPLICATIONS

This application is a Continuation of International Patent Application No. PCT/JP2020/020223, filed May 22, 2020, which claims the benefit of Japanese Patent Applications No. 2019-104719, filed Jun. 4, 2019, and No. 2019-117137, filed Jun. 25, 2019, all of which are hereby incorporated by reference herein in their entirety.

BACKGROUND OF THE INVENTION

Field of the Invention

The present invention relates to an inkjet printing apparatus and a printing method that perform printing by ejecting ink to a print medium, particularly to an inkjet printing apparatus and a printing method that perform multipass printing in which an image is completed by performing multiple print convenience operations on a unit region.

Background Art

PTL 1 discloses a full-line inkjet printing apparatus that conveys a print medium with a conveyor belt. In the inkjet printing apparatus of PTL 1, a print head ejects ink while being moved in a nozzle arrangement direction every time a conveyance direction of the print medium is switched to mitigate a decrease in image quality caused by deviation of ink landing positions and the like. Although the inkjet printing apparatus of PTL 1 has a configuration in which the conveyor belt conveys the print medium, a configuration in which two roller members of a conveyance roller and a pinch roller pinch the print medium and convey the print medium by being rotated is also generally used. In the case where the conveyance roller conveys the print medium, the conveyance roller is generally arranged close to a print unit to improve conveyance accuracy.

However, in a printing method in which printing is performed with the conveyance roller reciprocally conveying the print medium, the pinch roller and a region of the print medium to which the ink is applied sometimes come into contact with each other during the reciprocal conveyance operation of the print medium performed in the image formation. If the pinch roller and the region to which the ink is applied come into contact with each other, friction force between the pinch roller and the print medium changes and a conveyance error of the print medium may occur in some cases. If the conveyance error occurs, ink landing positions deviate from proper landing positions and this causes degradation of images such as characters and lines.

CITATION LIST

Patent Literature

PTL 1: Japanese Patent Laid-Open No. 2006-096022

SUMMARY OF THE INVENTION

Accordingly, the present invention provides a full-line inkjet printing apparatus and a printing method that can suppress occurrence of image degradation in the case where a conveyance roller conveys a print medium and multipass printing is performed.

To this end, an inkjet printing apparatus of the present invention is an inkjet printing apparatus including: a conveyance unit that conveys a print medium in a first direction and a second direction opposite to the first direction by rotating paired conveyance rollers configured to pinch the print medium; a print head that is provided downstream of the paired conveyance rollers in the first direction and that prints an image by ejecting ink to the print medium conveyed by the conveyance unit; and a control unit that controls the conveyance unit and the print head to print an image in a unit region of the print medium by alternately performing a first print conveyance operation and a second print conveyance operation, the first print conveyance operation being an operation of causing the conveyance unit to convey the print medium in the first direction while causing the print head to eject the ink to the unit region according to print data, the second print conveyance operation being an operation of causing the conveyance unit to convey the print medium in the second direction while causing the print head to eject the ink to the unit region according to the print data, and the control unit controls the conveyance unit such that the unit region subjected to printing by the print head is moved within such a range that the unit region is located downstream of the paired conveyance rollers in the first direction.

The present invention can provide an inkjet printing apparatus and a printing method that can suppress occurrence of image degradation.

Further features of the present invention will become apparent from the following description of exemplary embodiments with reference to the attached drawings.

BRIEF DESCRIPTION OF THE DRAWINGS

FIG. 7 is a table illustrating correspondence relationships between a type of print medium and a print mode;

FIG. 8A is a table illustrating another example of correspondence relationships between the print medium and the print mode;

FIG. 8B is a table illustrating another example of correspondence relationships between the print medium and the print mode;

FIG. 8C is a table illustrating another example of correspondence relationships between the print medium and the print mode;

FIG. 9 is a table illustrating correspondence relationships between an ink application amount and the print mode;

FIG. 11A is a table illustrating an example of correspondence relationships between various conditions and the print mode;

FIG. 11B is a table illustrating an example of correspondence relationships between various conditions and the print mode; and FIG. 11C is a table illustrating an example of correspondence relationships between various conditions and the print mode.

DESCRIPTION OF THE EMBODIMENTS

First Embodiment

A first embodiment of the present invention is described below with reference to the drawings.

Figure 1:
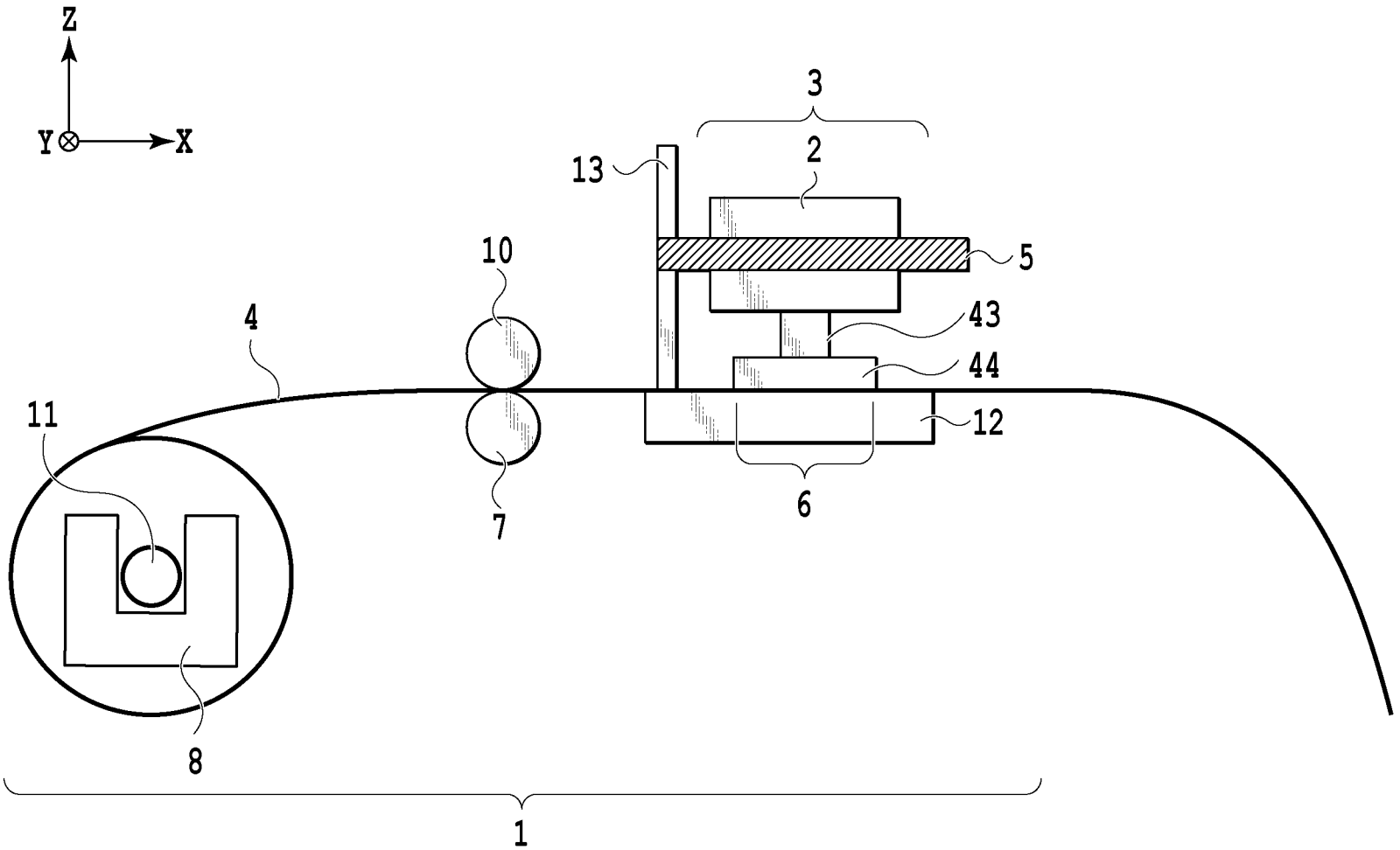
FIG. 1 is a schematic diagram illustrating a main portion of an inkjet printing apparatus.

FIG. 1 is a schematic diagram illustrating a main portion of an inkjet printing apparatus (hereinafter, also referred to as printing apparatus) 1 to which the embodiment can be applied. In the following drawings, an X direction is a substantial conveyance direction of a print medium 4, a Y direction intersecting the X direction is a width direction of the print medium 4, and a Z direction is the vertical direction. In the printing apparatus 1, a print medium holder 8 holds the print medium 4 wound in a roll shape and the print medium 4 wound in the roll shape is supported on a print medium shaft 11. The printing apparatus 1 includes a conveyance roller 7 and a pinch roller 10 that are paired conveyance rollers configured to pinch the print medium 4 and convey it in the conveyance direction at a predetermined speed. Rotationally driving the conveyance roller 7 causes the print medium 4 to be conveyed in the conveyance direction while being pinched by the conveyance roller 7 and the pinch roller 10. The printing apparatus 1 is a line printer that prints an image on the print medium 4 conveyed onto a platen 12 by using a long line print head (hereinafter, also referred to as print head) 2 while conveying the print medium 4 in the conveyance direction that is the X direction.

The printing apparatus 1 includes a print unit 3 and the print unit 3 includes a print head 2 that handles various ink colors. The print head 2 forms an image on the print medium by ejecting inks to the print medium according to print data. In the embodiment, the print unit 3 includes the print head 2 that handles inks of four colors of cyan (C), magenta (M), yellow (Y), and black (K). Note that the number of arranged print heads 2 and the number of colors of inks used in printing are not limited to those in the embodiment. The print head 2 is held in a head holder 5 and the head holder 5 is provided with a mechanism that moves the head holder 5 up and down in the Z direction along a head holder operation shaft 13 to allow changing of a distance between the print head 2 and the print medium 4.

Moreover, the head holder 5 is provided with a mechanism that moves the head holder 5 in the Y direction intersecting (orthogonal to in the embodiment) the conveyance direction of the print medium 4. The printing apparatus 1 includes a cleaning unit 6 at a position facing the print head 2 of the print unit 3, the cleaning unit 6 configured to clean a nozzle surface of the print head 2 provided with multiple nozzles with a wiper blade 43. The cleaning unit 6 includes the wiper blade 43 and a wiper holder 44 including the wiper blade 43 and is configured to be moved by a drive motor (not illustrated) along the nozzle surface of the print head 2, in the direction orthogonal to the conveyance direction. Furthermore, the printing apparatus 1 includes a not-illustrated cutter unit that cuts the print medium 4 and a not-illustrated sheet discharge basket that receives the print medium 4 subjected to printing, downstream of the print unit 3 in the X direction, along a conveyance route of the print medium 4.

FIG. 1 illustrates a state where the nozzle surface of the print head 2 is cleaned with the wiper blade 43. In the case where the printing apparatus 1 performs printing, the cleaning unit 6 is retreated from the position facing the nozzle surface and the head holder 5 is moved in the −Z direction along the head holder operation shaft 13 to set the distance between the print head 2 and the print medium 4 to a distance appropriate for printing.

Figure 2A:
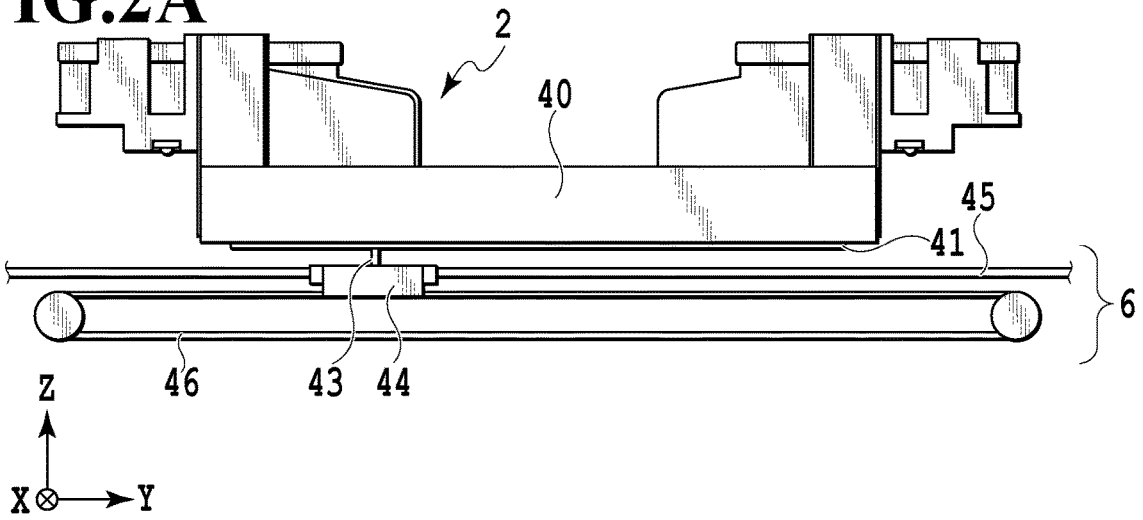
FIG. 2A is a diagram illustrating a print head.
Figure 2B:
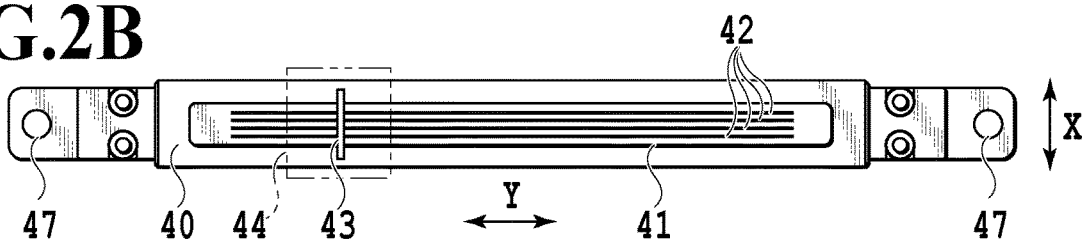
FIG. 2B is a diagram illustrating the print head.

FIGS. 2A to 2D are diagrams illustrating the print head 2. FIG. 2A illustrates the print head 2 and the cleaning unit 6 and illustrates the wiper blade 43 that wipes the nozzle surface of the print head 2. FIG. 2B is a diagram illustrating the print head 2 from the nozzle surface side. Various methods using ejection energy generation elements such as thermoelectric conversion elements (heaters), piezoelectric elements, electrostatic elements, and micro-electro-mechanical system (MEMS) elements can be employed as an inkjet method of ejecting the inks from the nozzles of the print head 2. The print head 2 is a full-line print head in which nozzle rows 42 are formed to extend over a range covering the maximum width of the print medium 4 assumed to be used.

An extending direction of the nozzle rows 42, that is the Y direction in which the nozzles capable of ejecting the inks are arranged is a direction intersecting (orthogonal to in the embodiment) the conveyance direction of the print medium 4 that is the X direction. The print head 2 includes a base substrate 40 and the base substrate 40 is provided with a nozzle chip 41. The nozzle chip 41 is a nozzle substrate in which the ejection energy generation elements corresponding to the nozzles forming the nozzle rows 42 are buried, and includes the nozzle surface in which the multiple nozzles are formed. In the embodiment, four nozzle rows 42 are arranged to correspond to the inks of four colors.

The wiper holder 44 provided in the cleaning unit 6 and including the wiper blade 43 is reciprocated in the Y direction by a drive belt 46 while being guided by a shaft 45. Moving the wiper holder 44 causes the wiper blade 43 to wipe the nozzle surface of the print head 2 and removes the inks and dust attaching to the nozzle surface.

Figure 2C:
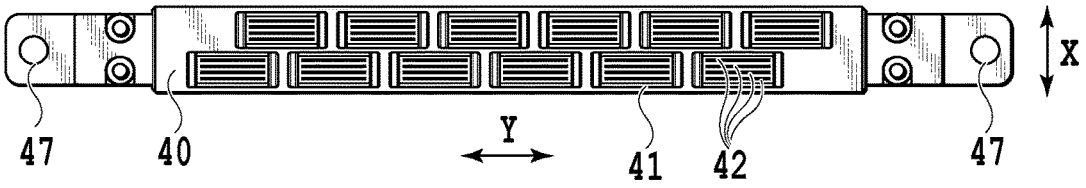
FIG. 2C is a diagram illustrating the print head.
Figure 2D:
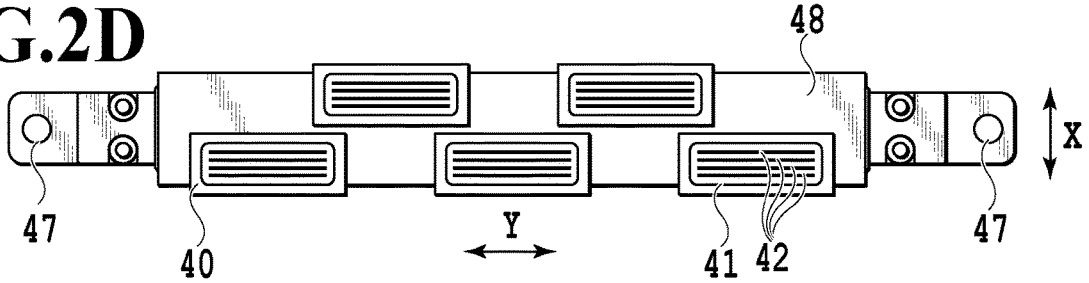
FIG. 2D is a diagram illustrating the print head.

In the print head 2 illustrated in FIG. 2B, one nozzle chip 41 is provided on one base substrate 40. However, the print head 2 may be configured in a mode as illustrated in FIG. 2C in which multiple nozzle chips 41 are arranged on one base substrate 40 or in a mode as illustrated in FIG. 2D in which multiple base substrates 40 are connected to one another by a supporting member 48.

Figure 3:
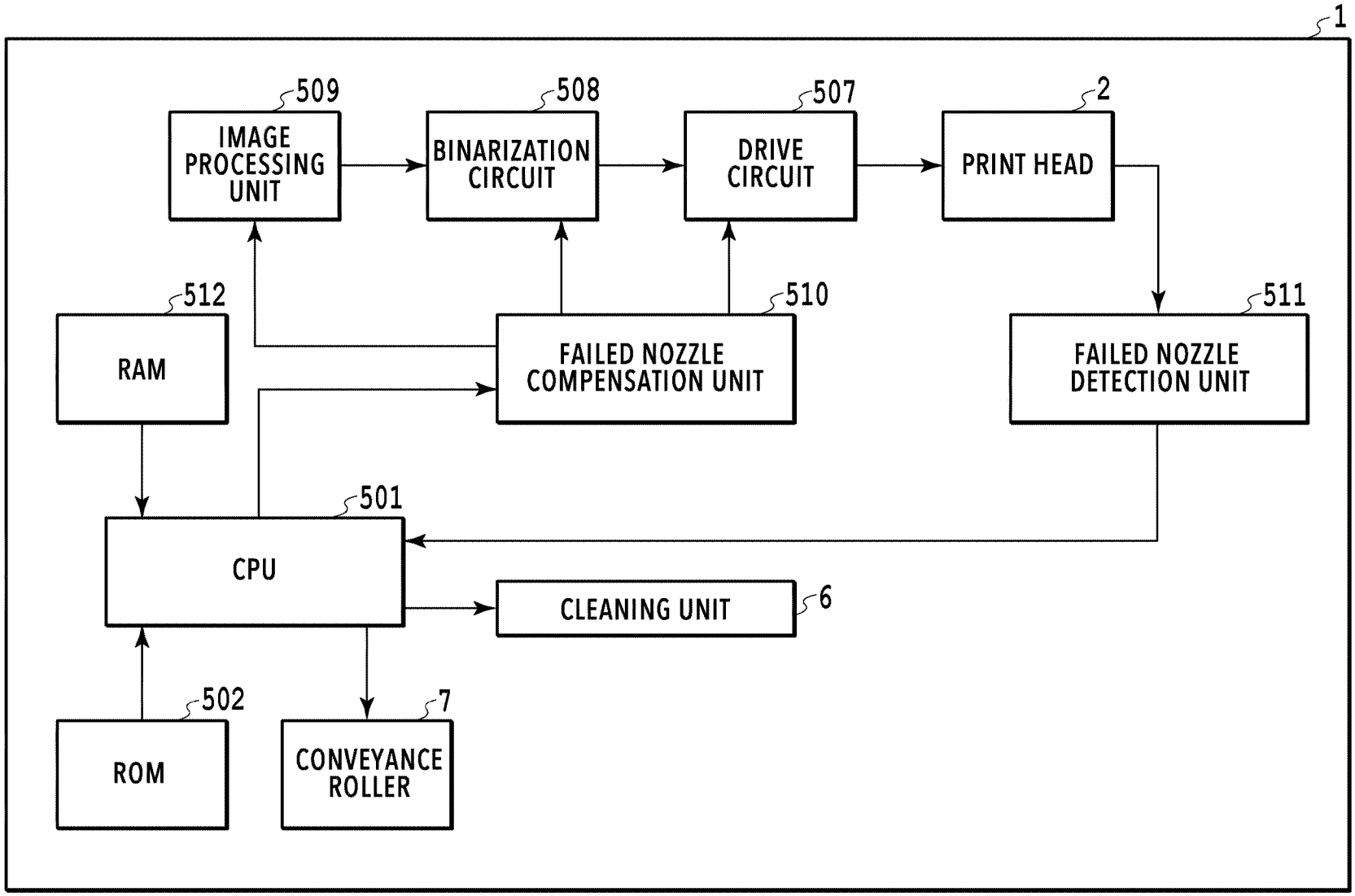
FIG. 3 is a block diagram illustrating a control system in the printing apparatus.

FIG. 3 is a block diagram illustrating a control system in the printing apparatus 1. A central processing unit (CPU) 501 reads a program that manages system control of the printing apparatus 1 from a read only memory (ROM) 502 and executes it to control the entire system according to this program. A random access memory (RAM) 512 is used as a work space for loading the program. Specifically, the RAM 512 temporarily stores input data, data necessary for processing executed by the CPU 501, and the like. Moreover, the CPU 501 also controls operations of the cleaning unit 6, the conveyance roller 7 that conveys the print medium, and the like. Furthermore, the CPU 501 controls a print operation by the print head 2 through a drive circuit 507, a binarization circuit 508, and an image processing unit 509.

The image processing unit 509 performs predetermined image processing on inputted color image data to be printed. Specifically, for example, the image processing unit 509 executes data conversion for mapping color gamut, reproduced by the inputted image data of color components of R, G, and B, to color gamut to be reproduced by the printing apparatus 1. Moreover, the image processing unit 509 performs processing of obtaining pieces of color separation data (pieces of density data for the respective components of C, M, Y, and K) corresponding to a combination of inks used to reproduce the color indicated by each piece of converted data, based on the converted data, and performs gray-scale conversion on the pieces of color separation data separated by color.

The binarization circuit 508 performs halftone processing or the like on the multi-level density image data converted by the image processing unit 509 and converts it to binary data (bit map data). The drive circuit 507 causes the inks to be ejected from the nozzles of the print head 2 according to the binary data obtained by the binarization circuit 508 and the like.

Figure 4:
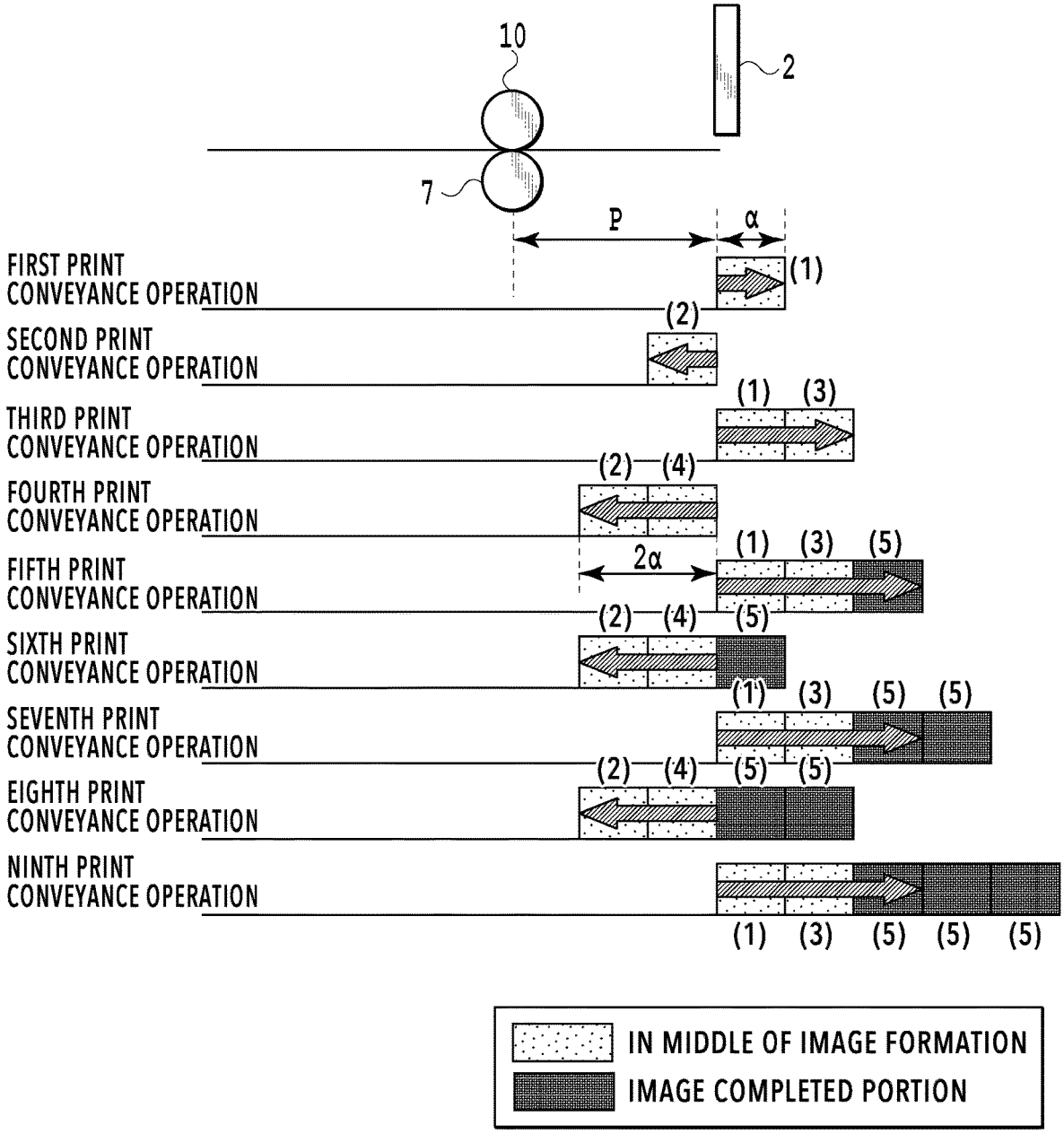
FIG. 4 is a diagram illustrating a printing method of multipass printing performed by the print head.

FIG. 4 is a diagram illustrating a printing method of multipass printing performed by the print head 2 of the embodiment. FIG. 4 illustrates a printing method of multipass printing (also referred to as five-pass printing) in which an image is completed in five print conveyance operations for a unit region. Moving the head holder 5 in the Y direction between one print conveyance operation and another print conveyance operation causes dots printed by the same nozzle not to be arranged in line in the X direction and can mitigate a decrease in image quality due to deviation of ink landing positions or the like. In the embodiment, the print conveyance operation in a forward direction and the print conveyance operation in a return direction that is a direction opposite to the forward direction are alternately performed to complete an image. Although an example of the five-pass printing is described in the embodiment, the present invention is not limited to the five-pass printing and the printing only needs involve two or more passes. Moreover, the print conveyance operation in the forward direction is performed as an initial print conveyance operation.

FIG. 4 illustrates printing from a first print conveyance operation to a ninth print conveyance operation and also illustrates relationships between the position of the print medium 4 and the positions of the print head 2, the conveyance roller 7, and the pinch roller 10 after completion of a print operation in each print conveyance operation. Each of arrows illustrated by being superimposed on print regions in the middle of image formation indicates the conveyance direction and the conveyance amount of the print medium in the corresponding print conveyance operation. Note that a right end portion in the drawing in which printing is performed in the first print conveyance operation is referred to as leading edge portion and the number in the parentheses illustrated above each unit region subjected to printing on the print medium indicates the number of times the printing is performed.

In the embodiment, a print region subjected to printing in the execution of the five-pass printing is always located on the print head side (right side in the drawing) of the pinch roller 10, and is not conveyed beyond the pinch roller 10 (from the right side of the pinch roller 10 to the left side thereof in the drawing). Specifically, the print region is moved within such a range that it is located downstream of the pinch roller 10 in the conveyance direction (forward direction). The printing can be thereby completed while avoiding contact between the pinch roller 10 and the print region to which the inks are applied. The inkjet printing apparatus that can suppress occurrence of image degradation while suppressing occurrence of conveyance error can be thus achieved. The printing method of the embodiment is described below.

First, in a first print conveyance operation, the print operation is performed in a first unit region of the print medium while the print medium 4 is conveyed in the forward direction by a conveyance amount (also referred to as unit conveyance amount) a. Next, in a second print conveyance operation, the print operation is performed in a superimposed manner in the first unit region subjected to printing in the first print conveyance operation while the print medium 4 is conveyed in the return direction by the conveyance amount $\alpha$. Thereafter, in a third print conveyance operation, the print operation is performed while the print medium 4 is conveyed in the forward direction by a conveyance amount $2\alpha$. In this case, a third print operation is performed in the first unit region from the leading edge portion to the conveyance amount $\alpha$ and a first print operation is performed in a second unit region from the conveyance amount $\alpha$ to the conveyance amount $2\alpha$.

In a fourth print conveyance operation, the print operation is performed while the print medium 4 is conveyed in the return direction by the conveyance amount $2\alpha$. In this case, a second print operation is performed in the second unit region from a print start position to the conveyance amount $\alpha$ and a fourth print operation is performed in the first unit region from the conveyance amount $\alpha$ to the conveyance amount $2\alpha$. In a fifth print conveyance operation, the print operation is performed while the print medium 4 is conveyed in the forward direction by a conveyance amount $3\alpha$. In this case, a fifth print operation is performed in the first unit region from a print start position being the leading edge portion to the conveyance amount $\alpha$, a third print operation is performed in the second unit region from the conveyance amount $\alpha$ to the conveyance amount $2\alpha$, and a first print operation is performed in a third unit region from the conveyance amount $2\alpha$ to the conveyance amount $3\alpha$. At this moment, the fifth print operation is completed and the image is completed in the first unit region from the leading edge portion to the conveyance amount $\alpha$.

In a sixth print conveyance operation, the print operation is performed while the print medium 4 is conveyed in the return direction by the conveyance amount $2\alpha$. In this case, a second print operation is performed in the third unit region from a print start position to the conveyance amount $\alpha$ and a fourth print operation is performed in the second unit region from the conveyance amount $\alpha$ to the conveyance amount $2\alpha$. In a seventh print conveyance operation, the print operation is performed while the print medium 4 is conveyed in the forward direction by the conveyance amount $3\alpha$. In this case, a fifth print operation is performed in the second unit region from a print start position to the conveyance amount $\alpha$, a third print operation is performed in the third unit region from the conveyance amount $\alpha$ to the conveyance amount $2\alpha$, and a first print operation is performed in a fourth unit region from the conveyance amount $2\alpha$ to the conveyance amount $3\alpha$. At this moment, the fifth print operation is completed and the image is completed in the first and second unit regions from the leading edge portion to the conveyance amount 2a.

In an eighth print conveyance operation, the print operation is performed while the print medium 4 is conveyed in the return direction by the conveyance amount $2\alpha$. In this case, a second print operation is performed in the fourth unit region from a print start position to the conveyance amount $\alpha$ and a fourth print operation is performed in the third unit region from the conveyance amount $\alpha$ to the conveyance amount 2α. In a ninth print conveyance operation, the print operation is performed while the print medium 4 is conveyed in the forward direction by the conveyance amount 3α. In this case, a fifth print operation is performed in the third unit region from a print start position to the conveyance amount α, a third print operation is performed in the fourth unit region from the conveyance amount α to the conveyance amount 2α, and a first print operation is performed in a fifth unit region from the conveyance amount 2α to the conveyance amount 3α. At this moment, the fifth print operation is completed and the image is completed in the first to third unit regions from the leading edge portion to the conveyance amount 3α. Repeating the aforementioned print operation enables image formation by five-pass printing while avoiding contact between the print region and the pinch roller 10.

It can be found that, in the five-pass printing in the embodiment, the print operation is performed such that a region in which printing is being performed is conveyed from the print head 2 toward the pinch roller 10 by the conveyance amount 2α at a maximum. In the embodiment, the conveyance amount α is controlled such that a relationship of distance P>distance Q is established, where the distance P is the distance between the print head 2 and the pinch roller 10 in a route through which the print medium is conveyed and the distance Q is the maximum conveyance amount 2α in the return route.

The embodiment is carried out in setting in which the distance P between the print head 2 and the pinch roller 10 is 65 mm and the distance Q being the maximum conveyance amount in the return route is 60 mm. Specifically, the conveyance amount a is 30 mm and, in the fifth pass and beyond, the print operation is performed while the print medium 4 is conveyed by 90 mm in the forward route and by 60 mm in the return route.

As described above, setting the maximum conveyance amount 2α in the return route smaller than the distance P between the conveyance roller 7 and the print head 2 allows the print medium 4 to be conveyed while avoiding contact between the pinch roller 10 and the print region in which the printing is being performed or completed on the print medium. This can suppress occurrence of variation in conveyance amount, that is conveyance error caused by the contact between the pinch roller 10 and a mid-printing or printing completed portion.

Second Embodiment

A second embodiment of the present invention is described below with reference to the drawings. Note that a basic configuration of this embodiment is the same as that of the first embodiment and characteristic configurations are thus described below.

In the first embodiment, the printing apparatus that performs the print control of the five-pass printing is described. The printing apparatus of the embodiment can perform print control of seven-pass printing in addition to the five-pass printing. A printing method in the printing apparatus of the embodiment is described below.

Figure 5A:
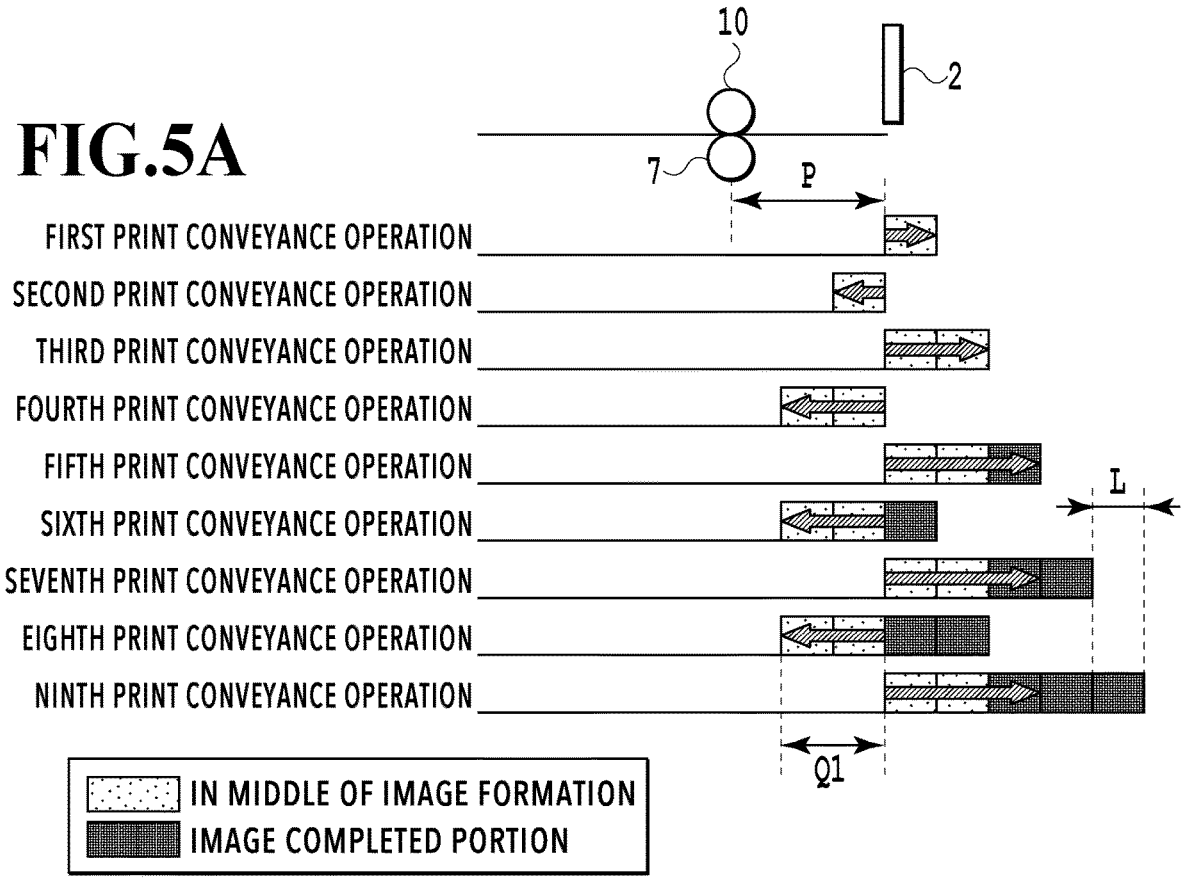
FIG. 5A is a diagram illustrating a printing method.
Figure 5B:
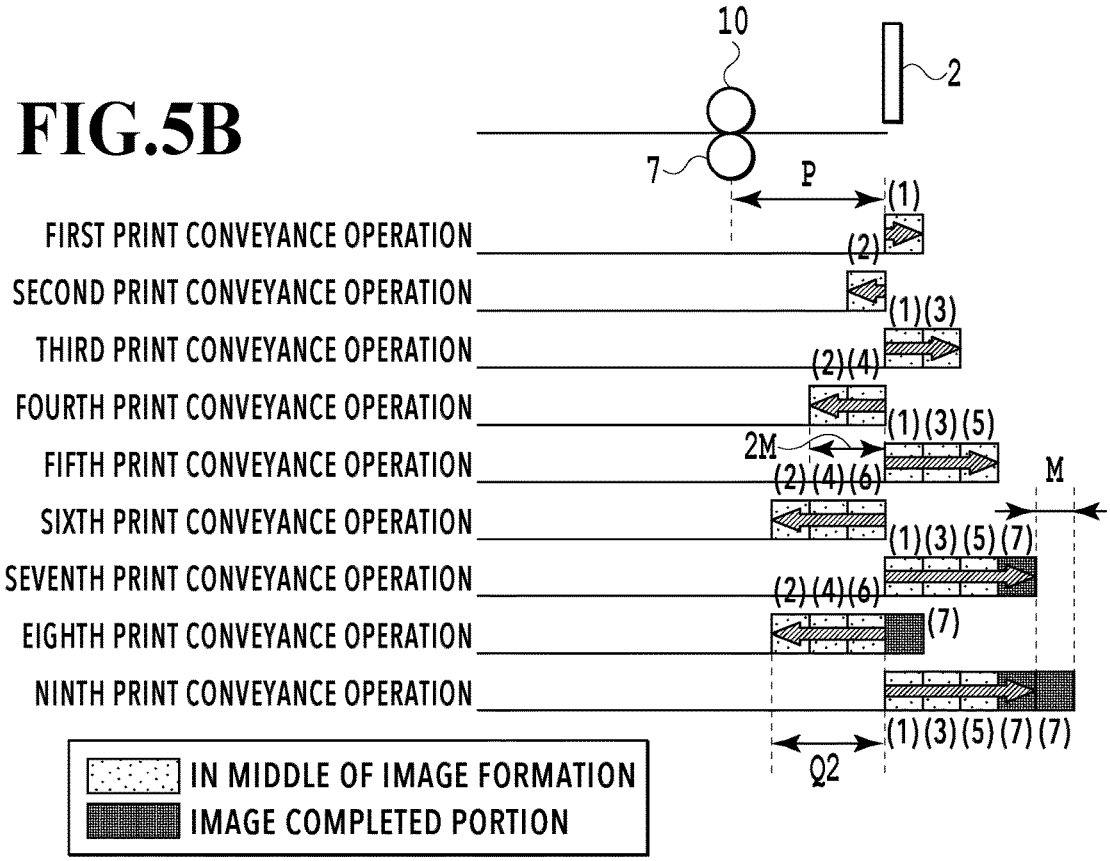
FIG. 5B is a diagram illustrating a printing method.

FIGS. 5A and 5B are diagrams illustrating a printing method of the embodiment. As described above, the printing apparatus of the embodiment can perform the print control of the five-pass printing and the seven-pass printing and has a five-pass mode that is a mode of performing the print control of the five-pass printing and a seven-pass mode that is a mode of performing the print control of the seven-pass printing.

FIG. 5A is a diagram illustrating a printing method in the five-pass mode. Since the printing method of the five-pass printing is the same as that in the first embodiment, description thereof is omitted. Although the unit conveyance amount in one pass is referred to as the conveyance amount α in the first embodiment, the unit conveyance amount is referred to as conveyance amount L and the distance that is the maximum conveyance amount in the return route is referred to as Q1 in this embodiment.

FIG. 5B is a diagram illustrating the printing method in the seven-pass mode. The printing method in the seven-pass printing of the embodiment is described below.

First, in a first print conveyance operation, the print operation is performed in a first unit region of the print medium while the print medium 4 is conveyed in the forward direction by a conveyance amount M. Next, in a second print conveyance operation, the print operation is performed in a superimposed manner in the first unit region subjected to printing in the first print conveyance operation while the print medium 4 is conveyed in the return direction by the conveyance amount M. Thereafter, in a third print conveyance operation, the print operation is performed while the print medium 4 is conveyed in the forward direction by a conveyance amount 2M. In this case, the third print operation is performed in the first unit region from a print start position being the leading edge portion to the conveyance amount M and the first print operation is performed in a second unit region from the conveyance amount M to the conveyance amount 2M.

In a fourth print conveyance operation, the print operation is performed while the print medium 4 is conveyed in the return direction by the conveyance amount 2M. In this case, a second print operation is performed in the second unit region from a print start position to the conveyance amount M and a fourth print operation is performed in the first unit region from the conveyance amount M to the conveyance amount 2M. In a fifth print conveyance operation, the print operation is performed while the print medium 4 is conveyed in the forward direction by a conveyance amount 3M. In this case, a fifth print operation is performed in the first unit region from a print start position being the leading edge portion to the conveyance amount M, a third print operation is performed in the second unit region from the conveyance amount M to the conveyance amount 2M, and a first print operation is performed in a third unit region from the conveyance amount 2M to the conveyance amount 3M.

In a sixth print conveyance operation, the print operation is performed while the print medium 4 is conveyed in the return direction by the conveyance amount 3M. In this case, a second print operation is performed in the third unit region from a print start position to the conveyance amount M, a fourth print operation is performed in the second unit region from the conveyance amount M to the conveyance amount 2M, and a sixth print operation is performed in the first unit region from the conveyance amount 2M to the conveyance amount 3M. In a seventh print conveyance operation, the print operation is performed while the print medium 4 is conveyed in the forward direction by a conveyance amount 4M. In this case, a seventh print operation is performed in the first unit region from a print start position being the leading edge portion to the conveyance amount M and a fifth print operation is performed in the second unit region from the conveyance amount M to the conveyance amount 2M. Moreover, a third print operation is performed in the third unit region from the conveyance amount 2M to the conveyance amount 3M and a first print operation is performed in a fourth unit region from the conveyance amount 3M to the conveyance amount 4M. At this moment, the seventh print operation is completed and the image is completed in a section from the leading edge portion to the conveyance amount M.

In an eighth print conveyance operation, the print operation is performed while the print medium 4 is conveyed in the return direction by the conveyance amount 3M. In this case, a second print operation is performed in the fourth unit region from a print start position to the conveyance amount M, a fourth print operation is performed in the third unit region from the conveyance amount M to the conveyance amount 2M, and a sixth print operation is performed in the second unit region from the conveyance amount 2M to the conveyance amount 3M. In a ninth print conveyance operation, the print operation is performed while the print medium 4 is conveyed in the forward direction by the conveyance amount 4M. In this case, a seventh print operation is performed in the second unit region from a print start position to the conveyance amount M and a fifth print operation is performed in the third unit region from the conveyance amount M to the conveyance amount 2M. Moreover, a third print operation is performed in the fourth unit region from the conveyance amount 2M to the conveyance amount 3M and a first print operation is performed in a fifth unit region from the conveyance amount 3M to the conveyance amount 4M. At this moment, the seventh print operation is completed and the image is completed in a section from the leading edge portion to the conveyance amount 2M.

Repeating the print operation while conveying the print medium 4 by the conveyance amount 4M in the forward route and conveying the print medium 4 by the conveyance amount 3M in the return route as described above in the seventh print conveyance operation and beyond enables image formation by seven-pass printing while avoiding contact between the print region and the pinch roller 10. In the seven-pass printing, distance Q2=conveyance amount 3M, where the distance Q2 is the maximum conveyance amount in the return route, and it is only necessary to set M to such a magnitude that distance P>distance Q2=3M is established. This embodiment is carried out in setting in which the conveyance amount M is 20 mm. In other words, the distance Q2 is 60 mm.

In this case, the larger the unit conveyance amount is, the better the so-called throughput is, provided that the number of passes is the same, the throughput being time required to complete a printed image. In the embodiment, the unit conveyance amount in one print conveyance operation is the conveyance amount L in the five-pass mode and is the conveyance amount M in the seven-pass mode. In order to improve the throughput, the conveyance amount control is preferably performed such that the unit conveyance amount is set as large as possible within a range in which the maximum conveyance amount in the return route does not exceed the distance P in both of the five-pass mode and the seven-pass mode. In the embodiment, the maximum conveyance amount in the return route is 60 mm in both of the five-pass mode and the seven-pass mode. Accordingly, the unit conveyance amount L in the five-pass mode is 30 mm and the unit conveyance amount M in the seven-pass mode is 20 mm. In other words, it can be found that a relationship of conveyance amount L>conveyance amount M is established.

In the case where multiple print modes varying in the number of passes are provided as described above, a unit conveyance amount in a print mode of a larger number of passes is set as large as possible within a range not exceeding a unit conveyance amount in a print mode of a smaller number of passes. This can achieve print control that suppresses a decrease in throughput while reducing conveyance error factors.

Although the printing apparatus having the five-pass mode and the seven-pass mode is described in the embodiment, the same applies to printing methods of other numbers of passes. For example, a unit conveyance amount in a print mode of nine-pass printing is smaller than the unit conveyance amount in the seven-pass mode. Moreover, the maximum number of unit regions subjected to printing in one print conveyance operation in the return route in the nine-pass mode is larger than that in the seven-pass mode.

Third Embodiment

A third embodiment of the present invention is described below with reference to the drawings. Note that a basic configuration of this embodiment is the same as that of the first embodiment and characteristic configurations are thus described below.

Figure 6A:
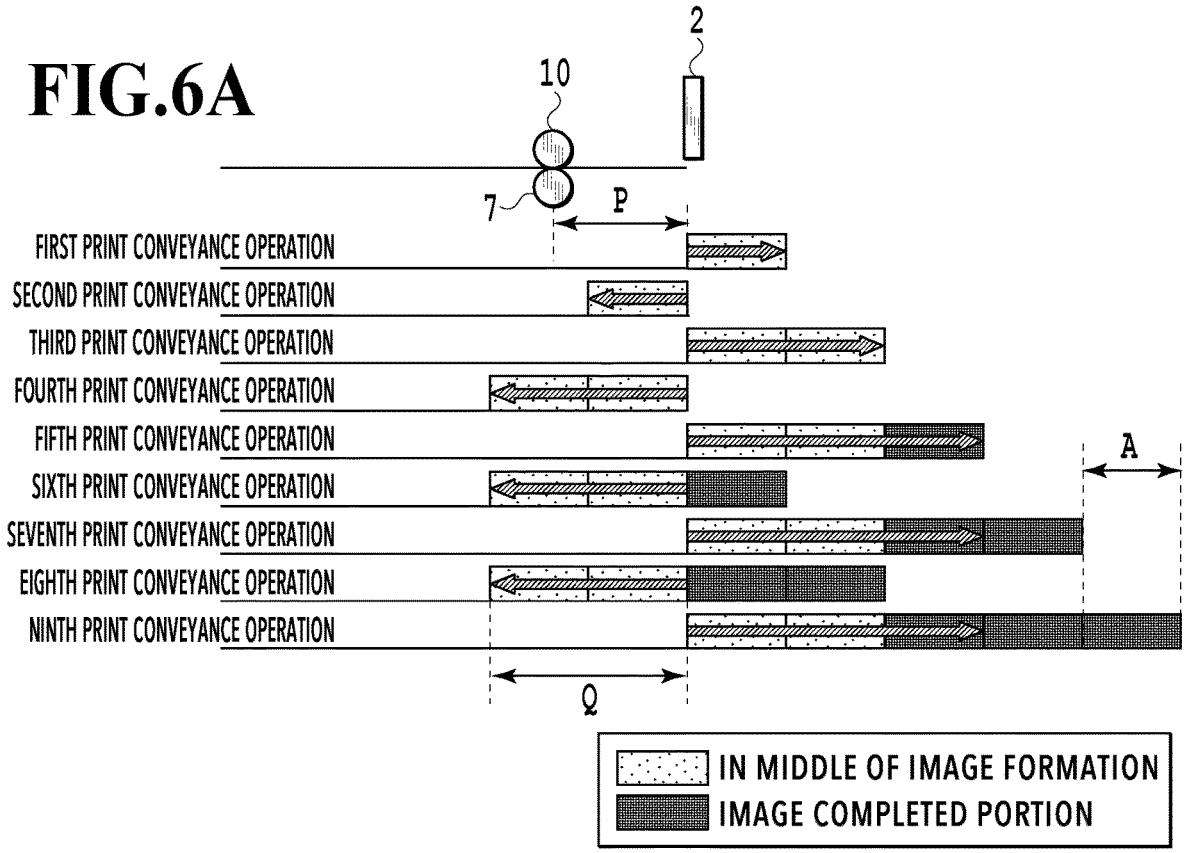
FIG. 6A is a diagram illustrating a printing method.
Figure 6B:
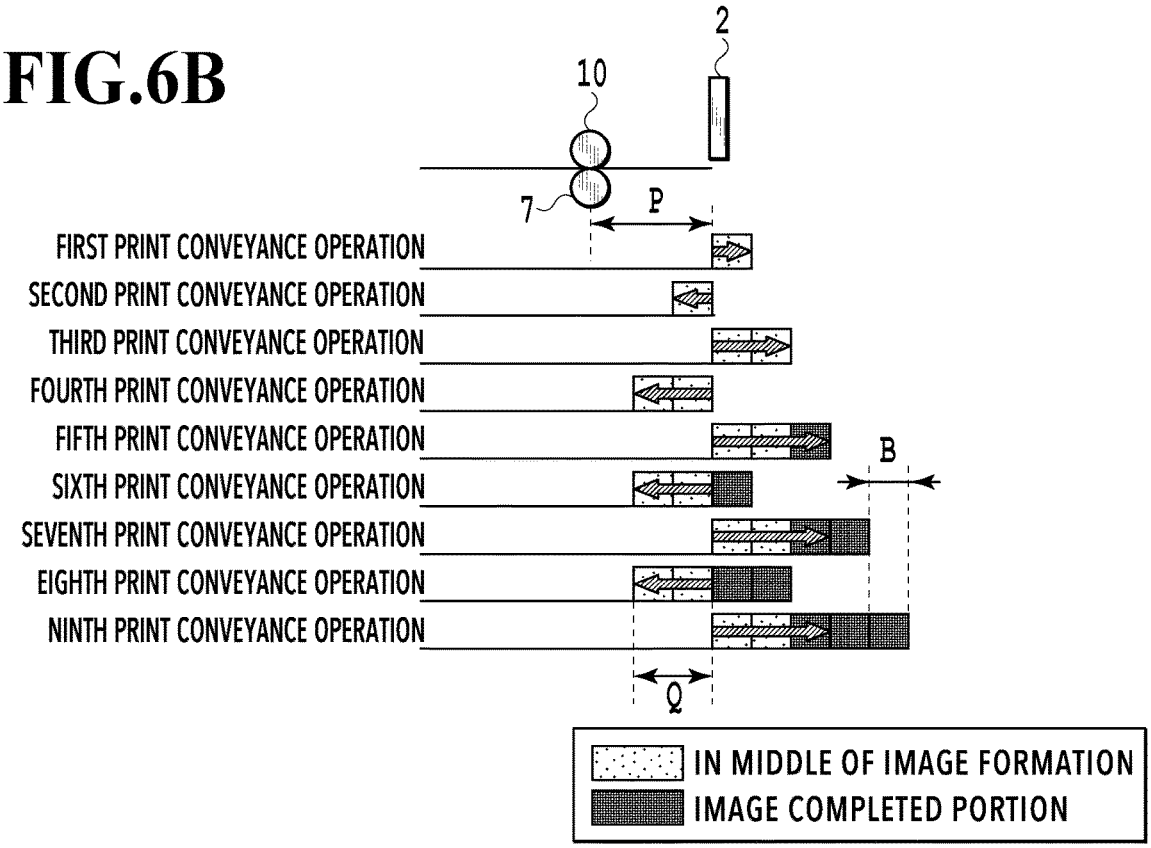
FIG. 6B is a diagram illustrating a printing method.

FIGS. 6A and 6B are diagrams illustrating a printing method in a printing apparatus of the embodiment. The printing apparatus of the embodiment can perform print control of five-pass printing in various unit conveyance amounts. The printing apparatus performs print control of five-pass printing in a unit conveyance amount A in a print mode A and performs print control of five-pass printing in a unit conveyance amount B in a print mode B. In this case, the unit conveyance amount A is larger than the unit conveyance amount B and a relationship of unit conveyance amount A>unit conveyance amount B is established. Since print operations in the print mode A and the print mode B are the same as that in the first embodiment, description thereof is omitted.

FIG. 6A illustrates a printing method in the print mode A and FIG. 6B illustrates a printing method in the print mode B. As described in the second embodiment, the larger the unit conveyance amount is, the better the throughput is, provided that the number of passes is the same. Thus, the throughput is better in the print mode A in which the unit conveyance amount is larger than that in the print mode B. However, in the print mode A, the distance Q that is the maximum conveyance amount in the return route is distance Q=conveyance amount 2A and a relationship of distance P<distance Q is established. Accordingly, in the print mode A, the pinch roller 10 comes into contact with the mid-printing or printing completed portion and the inks attach to the pinch roller 10. Thus, occurrence of variation in the conveyance amount, that is the conveyance error cannot be suppressed. Note that, in the embodiment, the distance P is 65 mm, the conveyance amount A is 60 mm, and the conveyance amount B is 30 mm.

Accordingly, in the embodiment, the print mode A is regarded as a draft mode. The print mode A is a configuration with lower conveyance accuracy than the print mode B but is effective in a situation where a high throughput is desired over print accuracy. Moreover, for example, the ink application amount onto the print medium may be reduced in the print mode A. In this case, although the pinch roller 10 comes into contact with the mid-printing or printing completed region, since the ink application amount is small, the degree of conveyance error can be made close to that in the print mode B.

Although description is given of the example in which the unit conveyance amount varies between the printing methods of the same number of passes for the two print modes of the print mode A and the print mode B in the embodiment, the numbers of passes in the respective printing methods do not have to be the same. The configuration may be such that conveyance control in which the pinch roller does not come into contact with the mid-printing or printing completed portion is performed in one of printing methods varying in the number of passes and conveyance control in which the pinch roller comes into contact with the mid-printing or printing completed portion is performed in the other one of printing methods.

Fourth Embodiment

A fourth embodiment of the present invention is described below with reference to the drawings. Note that a basic configuration of this embodiment is the same as that of the first embodiment and characteristic configurations are thus described below.

In the print mode A in the third embodiment described above, the pinch roller 10 comes into contact with the mid-printing portion or printing completed portion. In the case where the pinch roller 10 comes into contact with a wet print medium surface as described above, the surface of the print medium deforms and this deformation is resultantly recognized as unevenness in some cases. In this specification, a negative effect on an image caused by such contact between the print medium and the pinch roller 10 is referred to as conveyance mark unevenness.

A degree of obviousness of the conveyance mark unevenness varies depending on the type of print medium and the like. For example, in glossy paper and a film-based print medium that have relatively smooth surfaces, deformation that occurs with conveyance involving contact with the pinch roller 10 (hereinafter, also referred to as nip conveyance) is large and the conveyance mark unevenness tends to be obvious. Meanwhile, in ordinary paper and coated paper having surfaces in which relatively large protrusions and recesses are formed, the deformation that occurs with the nip conveyance is small and the conveyance mark unevenness tends to be less obvious. In view of this, in the embodiment, an appropriate print mode is selected from the print mode A and the print mode B depending on the type of print medium.

FIG. 7 is a table illustrating correspondence relationships between the type of print medium and the print mode. For example, the user may specify the type of print medium through an operation panel of the printing apparatus or a printer driver installed in a host apparatus connected to the printing apparatus 1. Alternatively, a sensor arranged in the printing apparatus 1 may detect the type of print medium. In any case, the CPU 501 sets the print mode to one of the print mode A and the print mode B based on the specified type of print medium. Then, in the print mode A, the multipass printing of five passes is performed according to the printing method described in FIG. 6A with the conveyance amount A set to 60 mm. Meanwhile, in the print mode B, the multipass printing of five passes is performed according to the printing method described in FIG. 6B with the conveyance amount B set to 30 mm.

As illustrated in FIG. 7, the print mode is set to the print mode A involving the nip conveyance for the ordinary paper and the coated paper in the embodiment. In the ordinary paper and the coated paper, a change in the surface shape is small even if the nip conveyance is performed with the ink absorbed in the paper, and the conveyance mark unevenness tends to be less obvious. Accordingly, in the case where the used paper is the ordinary paper or the coated paper, high-speed output is given higher priority than reduction of the conveyance mark unevenness and the print mode is set to the print mode A.

Meanwhile, the print mode is set to the print mode B involving no nip conveyance for the glossy paper, semi-glossy paper, art paper, and a film in the embodiment. Although surfaces of the glossy paper, the semi-glossy paper, and the film are smooth, these materials swell or soften by absorbing the ink and become more likely to be affected by external force. Specifically, a region for which the nip conveyance is performed deforms and the conveyance mark unevenness is likely to become obvious in this region. The art paper is relatively thick and has a surface with large protrusions and recesses. However, in the case where the nip conveyance is performed with the ink absorbed in the art paper, the protrusions and recesses deform by pressure contact with the nip portion and the conveyance mark unevenness is likely to become obvious. Accordingly, in the case where the print medium is the glossy paper, the semi-glossy paper, the art paper, or the film, reduction of the conveyance mark unevenness is given higher priority than high-speed output and the print mode is set to the print mode B involving no nip conveyance.

As described above, in the embodiment, the print mode in which the conveyance distance is large and the image output involves the nip conveyance and the print mode in which the conveyance distance is small and the image printing involves no nip conveyance are prepared for the full-line inkjet printing apparatus. Then, one of these print modes is appropriately selected and set depending on the type of print medium. This enables output of a high-quality image independent of the type of print medium.

Modified Example of Fourth Embodiment

Although the print mode is set depending on the type of print medium, that is the material of print medium in the aforementioned section, the obviousness of the conveyance mark unevenness varies depending on various elements other than the material of print medium. FIGS. 8A to 8C are tables illustrating other examples of the correspondence relationships between the print medium and the print mode. The obviousness of conveyance mark unevenness sometimes depends on, for example, a degree of protrusions and recesses on the surface of the print medium, that is surface roughness. In a print medium with high surface roughness, the ink tends to enter recess portions of protrusions and recesses. Accordingly, even if the conveyance mechanism comes into pressure contact with the surface, the effect on a region permeated by the ink is small and the conveyance mark unevenness is less likely to appear. In other words, the aforementioned print mode may be set in link with the surface roughness.

FIG. 8A illustrates a case where the print mode is set depending on the surface roughness. The surface roughness can be measured in various methods and, in FIG. 8A, values measured by using a non-contact type laser microscope are illustrated. In FIG. 8A, a print mode A' in which the conveyance amount is further increased to conveyance amount A'=80 mm is prepared in addition to the aforementioned print mode A and the print mode B. The print mode is set to the print mode A' for the ordinary paper having even higher roughness than the coated paper.

The print mode A and the print mode A' have a commonality that they both involve the nip conveyance. However, in the print mode A' in which the conveyance amount is large, the conveyance mark unevenness is more likely to be obvious than in the print mode A and the throughput is improved from that in the print mode A by a degree corresponding to an increase in the distance of nip conveyance. Accordingly, in the modified example, the print mode is set to the print mode A' for the ordinary paper that has higher surface roughness than the coated paper and in which the conveyance mark unevenness is less likely to be obvious than in the coated paper, and the throughput is improved from that of the coated paper.

Note that the print mode is set to the print mode B involving no nip conveyance for the glossy paper, the semi-glossy paper, and the film with relatively low surface roughness.

FIG. 8B illustrates the case where the print mode is set depending on the thickness of each of print media that are all coated paper. The larger the thickness of the print medium is, the higher the nip pressure received by the print medium in the nip conveyance is, and the more likely the surface deforms. Accordingly, even in the print media made of the same material, the larger the thickness of the print medium is, the more likely the conveyance mark unevenness is to be obvious.

In FIG. 8B, the print mode is set to the print mode A' for coated paper A with the smallest thickness (90 μm), to the print mode A for coated paper B with standard thickness (180 μm), and to the print mode B for coated paper C with the largest thickness (300 μm).

FIG. 8C illustrates a case where the print mode is set depending on an ink absorption performance of each of print media that are all coated paper. This method is employed because the lower the ink absorption performance of the print medium is, the more likely the ink is to be transferred to the conveyance mechanism in the nip conveyance, and the more likely the conveyance mark unevenness is to be recognized. The ink absorption performance can be quantified by various methods and, in FIG. 8C, an ink transfer amount is used as the ink absorption amount.

The transfer amount can be measured by using Bristow's method described in "test method of liquid absorbability of paper and paperboard" in paper and pulp test method No. 51 of JAPAN TAPPI. The method of measuring the ink transfer amount is briefly described below. First, a certain amount of ink is poured into a holding container including an opening slit of a predetermined size. The ink in the container is brought into contact with a strip-shaped print medium wound around a disc through the slit and the disc is rotated with the holding container fixed. Next, the area (length) of an ink band transferred onto the print medium is measured and the transfer amount ($ml/m^2$) per unit area is calculated from the area of the ink band. The transfer amount ($ml/m^2$) indicates a volume of ink absorbed by the print medium in predetermined time and the predetermined time is defined as transfer time. The transfer time (millisecond^½) corresponds to the contact time between the slit and the print medium and is converted by using the speed of the disc and the width of the opening slit.

In FIG. 8C, the print mode is set to the print mode A' for coated paper D with the largest transfer amount (40 $ml/m^2$), to the print mode A for coated paper E with a standard transfer amount (30 $ml/m^2$), and to the print mode B for coated paper F with the smallest transfer amount (18 $ml/m^2$).

A high-quality image can be stably outputted by appropriately setting the print mode to the print mode in which the image output involves the nip conveyance and the print mode in which the image printing involves no nip conveyance, depending on various elements of the print medium as described above.

Fifth Embodiment

In the print medium, the larger the ink application amount is, the higher the possibility of deformation of the print medium surface or transfer of ink to the conveyance mechanism due to the nip conveyance is. Accordingly, in the embodiment, the print mode is set depending on the ink application amount to the print medium, that is based on print data and an image to be printed.

FIG. 9 is a table illustrating correspondence relationships between the ink application amount and the print mode in the embodiment. In this table, a printing ratio of dots to multiple pixel regions arranged in the print medium is illustrated as the ink application amount (%). In the case where dots are printed in all pixel regions arranged in the print medium, the ink application amount is 100%. In the case where dots are printed in none of the pixel regions, the ink application amount is 0%. Such an ink application amount (printing ratio) may be obtained by the host apparatus based on the image data or obtained by the CPU 501 based on the print data generated by the image processing unit 509.

In the embodiment, in the case where the ink application amount is less than 30%, the CPU 501 sets the print mode to the print mode A'. In the case where the ink application amount is 30% or more and is less than 90%, the CPU 501 sets the print mode to the print mode A. In the case where the ink application amount is 90% or more, the CPU 501 sets the print mode to the print mode B.

As described above, in the embodiment, in the case of printing an image in which the ink application amount is small and the conveyance mark unevenness is less likely to be obvious on the coated paper, the length of the unit region is set to a large value to improve the throughput. Meanwhile, in the case of printing an image in which the ink application amount is large and the conveyance mark unevenness is likely to be obvious on the same coated paper, the length of the unit region is set to a small value to avoid involvement of the nip conveyance.

Although the printing ratio to the pixel regions in the entire page is described as the ink application amount in FIG. 9, the method of calculating the ink application amount is not limited to this configuration. For example, all pixel regions in the print medium may be divided into sections each including a predetermined number of pixels and the average of the print ratios obtained in the respective divided sections may be set as the ink application amount of this page. Alternatively, the maximum value of the print ratio in the multiple divided sections may be set as the ink application amount of this page.

Furthermore, the print mode described in FIG. 9 can be switched to vary among the different sections in the same page. For example, in the case where a first object in which the ink application amount is large and a second object in which the ink application amount is small are arranged away from each other in the conveyance direction, it is possible to print the first object in the print mode B involving no nip conveyance and print the second object in the print mode A involving the nip conveyance. In this case, the CPU 501 only needs to obtain the ink application amount for each of predetermined sections in the conveyance direction and set the aforementioned print mode for each of the predetermined sections.

Moreover, in the case where there are unit regions in which the ink application amount is 0%, the CPU 501 may skip the print conveyance step for these unit regions and convey the print medium to a unit region in which the ink application amount is not 0% in one operation. Specifically, conveyance of performing plain conveyance in unit regions in which the ink application amount is 0% and performing print conveyance in a unit region in which the ink application amount is not 0% in one operation is referred to as collective conveyance.

Figure 10:
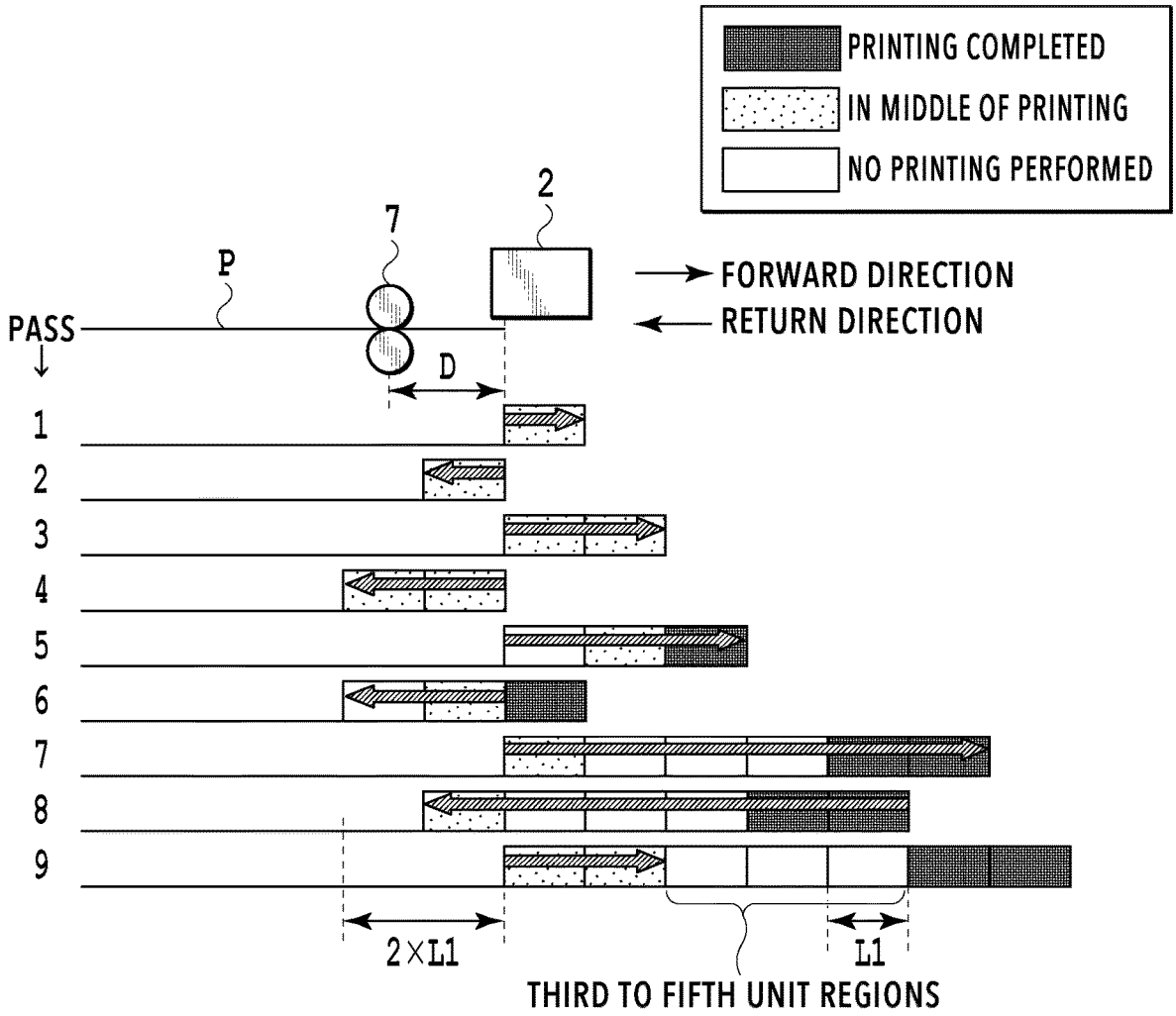
FIG. 10 is a diagram illustrating an example of collective conveyance.

FIG. 10 is a diagram illustrating an example of the aforementioned collective conveyance. This diagram illustrates a printing state in the print mode A in the case where the ink application amount is 0% in third to fifth unit regions. As compared to the standard multipass printing of five passes illustrated in FIG. 6A, the same print conveyance operations as those in FIG. 6A is performed up to the sixth pass but, in the seventh pass, the print medium is conveyed to a position where the print conveyance operation can be performed on a sixth unit region, in one operation. Specifically, in the seventh pass, the print conveyance operations for the third to fifth unit regions are skipped and a first print conveyance operation for the sixth unit region is performed. Performing such collective conveyance can improve the throughput by an amount corresponding to skipping of the print conveyance operations.

Although the case where printing is performed in the same print mode (print mode A) for the first and second unit regions and the sixth unit regions and beyond is described in FIG. 10, these two groups of unit regions may be printed in different print modes depending on the ink application amount in each group.

Moreover, the collective conveyance as described above is not limited to this embodiment. Also in the case where the print mode is set based on the print medium as in the fourth embodiment, it is possible to skip the print conveyance operations for regions in which the ink application amount is 0% and convey the print medium to the next unit region in which the ink application amount is not 0% in one operation, as long as the regions in which the ink application amount is 0% can be detected.

As described above, in the embodiment, the print mode in which the image output involves the nip conveyance and the print mode in which the image printing involves no nip conveyance is appropriately set depending on the ink application amount on the print medium. This enables output of a high-quality image independent of image data.

Other Embodiments

The degree of obviousness of the conveyance mark unevenness sometimes depends on various conditions other than the characteristics of the print medium described in the fourth embodiment and the ink application amount described in the fifth embodiment. FIGS. 11A to 11C are tables illustrating examples of correspondence relationships between various conditions and the print mode.

FIG. 11A illustrates the case where the print mode is set depending on the type of ink to be used. Generally, dye ink tends to have a high permeating property and pigment ink tends to have a low permeating property to the print medium. Since the pigment ink is more likely to remain on the surface of the print medium than the dye ink, the pigment ink has a higher coloring property but the conveyance mark unevenness due to the nip conveyance is likely to be obvious. Accordingly, in FIG. 11A, the print mode is set to the print mode A involving the nip conveyance in the case where the ink to be used is the dye ink, and to the print mode B involving no nip conveyance in the case where the ink to be used is the pigment ink. This enables printing of a high-quality image without the conveyance mark unevenness, independent of the type of ink to be used.

FIG. 11B illustrates the case where the print mode is set depending on the environmental temperature. Generally, the higher the environmental temperature is, the lower the fixability of the ink to the print medium is, and the more likely the conveyance mark unevenness due to the nip conveyance is to be obvious. Accordingly, in FIG. 11B, the print mode is set to the print mode A' involving the nip conveyance in the case where the environmental temperature is lower than 15° C., and to the print mode A involving the nip conveyance in the case where the environmental temperature is 15° C. or higher and lower than 28° C. Moreover, the print mode is set to the print mode B involving no nip conveyance in the case where the environmental temperature is 28° C. or higher. A print mode appropriate for the environmental temperature is thereby set even if the temperature of an environment in which the printing apparatus is used changes, and a high-quality image without the conveyance mark unevenness can be printed as fast as possible.

FIG. 11C illustrates the case where the print mode is switched depending on environmental humidity. Generally, the higher the environmental humidity is, the lower the fixability of the ink to the print medium is, and the more likely the conveyance mark unevenness and the transfer due to the nip conveyance are to be obvious. Accordingly, in FIG. 11C, the print mode is set to the print mode A' involving the nip conveyance in the case where the environmental humidity is lower than 30%, and to the print mode A involving the nip conveyance in the case where the environmental humidity is 30% or higher and lower than 60%. Moreover, the print mode is set to the print mode B involving no nip conveyance in the case where the environmental humidity is 60% or higher. A print mode appropriate for the environmental humidity is thereby set even if the humidity of an environment in which the printing apparatus is used changes, and a high-quality image without the conveyance mark unevenness can be printed as fast as possible.

The embodiments and modified examples described above may be combined. For example, as a combined mode of the fourth embodiment and the fifth embodiment, the CPU 501 can set the print mode based on the type of print medium and the ink application amount. Moreover, FIGS. 11A to 11C may be combined such that, for example, in the case where the dye ink is used, different print modes are set respectively for the case where the environmental temperature and the environmental humidity are high and for the case where they are low. Such configurations can be achieved by storing a multi-dimension table that determines one print mode based on multiple parameters such as the type of print medium, the ink application amount, and the environmental temperature, in the ROM 502. The CPU 501 may refer to the aforementioned multi-dimension table and set one print mode based on the multiple parameters.

Moreover, the types of print modes are not limited to the three types described in the aforementioned embodiments. Multiple print modes obtained by further varying the unit region length in each of the modes involving the nip conveyance and the mode involving no nip conveyance may be prepared.

Moreover, multiple print modes varying in the number of passes may be prepared. For example, in the fourth embodiment, the configuration may be such that the multipass printing of five passes illustrated in FIG. 6A is performed in the case where the print medium is the ordinary paper and multipass printing of eight passes is performed in the case where the print medium is the coated paper. Both multiplass print operations involve the nip conveyance in the case where the unit region length is set to A (see FIG. 6A).

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An inkjet printing apparatus comprising:

a pair of conveyance rollers configured to convey a print medium in a first direction and a second direction opposite to the first direction;

a print head, provided downstream of the pair of conveyance rollers in the first direction, the print head being configured to print an image by ejecting ink; and a control unit configured to control the print head and the pair of conveyance rollers to print an image in a unit region of the print medium by performing a first print operation and a second print operation, the first print operation being an operation of printing to the unit region by conveying the print medium in the first direction, and the second print operation being an operation of printing on the unit region by conveying the print medium in the second direction, wherein the control unit (1) selects a print mode among (a) a first print mode in which the pair of conveyance rollers nips the unit region where ink has been ejected and (b) a second print mode in which the pair of conveyance rollers does not nip the unit region where ink has been ejected, and (2) performs the selected print mode.

2. The inkjet printing apparatus according to claim 1, wherein initial printing is performed by the first print operation.

3. The inkjet printing apparatus according to claim 1, wherein the print head ejects multiple colors of ink.

4. The inkjet printing apparatus according to claim 1, wherein the print head is moved between the first print operation and the second print conveyance operation.

5. The inkjet printing apparatus according to claim 1, wherein the control unit performs the first print mode or the second print mode depending on a type of the print medium.

6. The inkjet printing apparatus according to claim 5, wherein the control unit performs the first print mode for a print medium with surface roughness of a first value and performs the second print mode for a print medium with surface roughness of a second value smaller than the first value.

7. The inkjet printing apparatus according to claim 5, wherein the control unit performs the first print mode for a print medium with a first thickness and performs the second print mode for a print medium with a second thickness larger than the first thickness.

8. The inkjet printing apparatus according to claim 5, wherein the control unit performs the first print mode for a print medium with a transfer amount of a first value and performs the second print mode for a print medium with a transfer amount of a second value smaller than the first value.

9. The inkjet printing apparatus according to claim 5, wherein the control unit performs the first print mode for a region in which an ink application amount is a first value and performs the second print mode for a region in which the ink application amount is a second value larger than the first value.

10. The inkjet printing apparatus according to claim 1, wherein the control unit performs the first print mode in a case where an ink application amount to the print medium is a first value and performs the second print mode in a case where the ink application amount is a second value larger than the first value.

11. The inkjet printing apparatus according to claim 1, wherein the control unit performs the first print mode in a case where the ink is dye ink and performs the second print mode in a case where the ink is pigment ink.

12. The inkjet printing apparatus according to claim 1, wherein the control unit performs the first print mode in a case where an environmental temperature is a first temperature and performs the second print mode in a case where the environmental temperature is a second temperature higher than the first temperature.

13. The inkjet printing apparatus according to claim 1, wherein the control unit performs the first print mode in a case where an environmental humidity is a first humidity and performs the second print mode in a case where the environmental humidity is a second humidity higher than the first humidity.

14. A printing method of an inkjet printing apparatus, the apparatus including: (a) a pair of conveyance rollers configured to convey a print medium in a first direction and a second direction opposite to the first direction and (b) a print head, provided downstream of the pair of conveyance rollers in the first direction, the print head being configured to print an image by ejecting ink, the printing method comprising:

printing an image in a unit region of the print medium by performing a first print operation and a second print operation, the first print operation being an operation of printing to the unit region by conveying the print medium in the first direction, and the second print operation being an operation of printing to the unit region by conveying the print medium in the second direction;

selecting a print mode among (a) a first print mode in which the pair of conveyance rollers nips the unit region where ink has been ejected and (b) a second print mode in which the pair of conveyance rollers does not nip the unit region where ink has been ejected; and performing the selected print mode.

* * * * *